US005087141A

United States Patent [19]

Kelly

[11] Patent Number: 5,087,141

[45] Date of Patent: Feb. 11, 1992

[54] COMBINATION PINCH ROLLER AND CARRIAGE GUIDE FOR PRINTER

[75] Inventor: Kieran B. Kelly, Vancouver, Wash.

[73] Assignee: Hewlett-Packard Company, Palo Alto, Calif.

[21] Appl. No.: 452,908

[22] Filed: Dec. 19, 1989

[51] Int. Cl.[5] ..... B41J 25/304

[52] U.S. Cl. ..... 400/352; 400/59; 400/320

[58] Field of Search ..... 400/352, 625, 320, 354, 400/354.1, 636, 55-58, 59

[56] References Cited

U.S. PATENT DOCUMENTS

| | | | |
|---|---|---|---|
| 4,420,269 | 12/1983 | Ackermann et al. | 400/320 |
| 4,589,784 | 5/1986 | Valle et al. | 400/56 |
| 4,798,374 | 1/1989 | Ito | 400/625 |
| 4,842,261 | 6/1989 | Thogersen et al. | 400/625 |
| 4,961,658 | 10/1990 | Takagi | 400/320 |

FOREIGN PATENT DOCUMENTS

| | | | |
|---|---|---|---|
| 0184872 | 8/1987 | Japan | 400/352 |

*Primary Examiner*—Edgar S. Burr
*Assistant Examiner*—John S. Hilten

[57] ABSTRACT

A printer in which a single pinch roller serves the dual function of a pinch roller cooperating with the drive roller to feed paper to the printing zone, and a carriage guide to guide movement of the printhead carriage. This roller automatically properly references the printhead to the printing surface, regardless of paper thickness. The printhead carriage, which is pivotally mounted to a carriage guide rod, rests in contact with and rides along the roller. Preferably, the center of gravity of the printhead carriage is spaced from the carriage guide rod and is disposed above the pinch roller, and the pinch roller is spaced from the carriage guide rod, so that the printhead carriage is preloaded into continual contact with the carriage guide rod. The carriage guide rod may be disposed either on the same side of the printhead carriage as the pinch roller, or on the opposite side of the carriage from the pinch roller.

30 Claims, 3 Drawing Sheets

FIG. 2
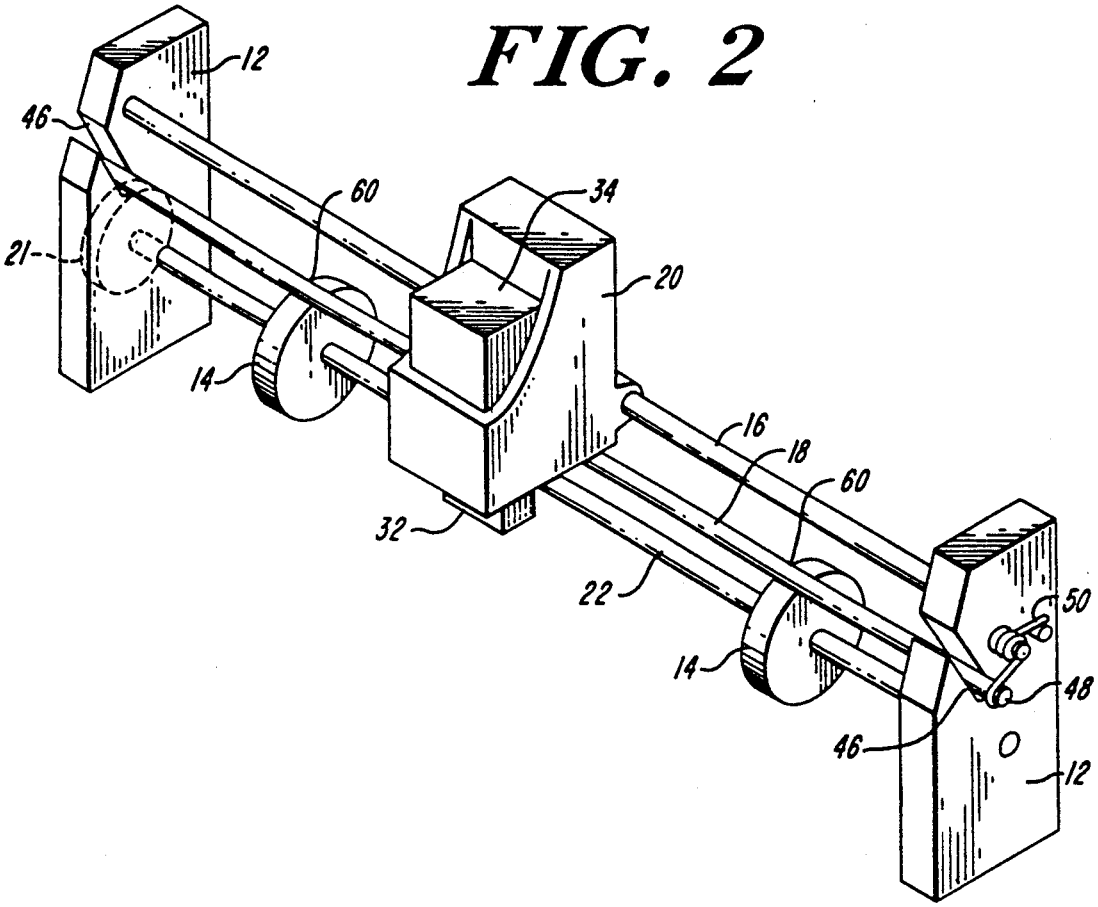
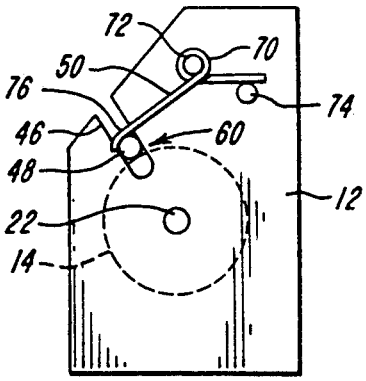
FIG. 3
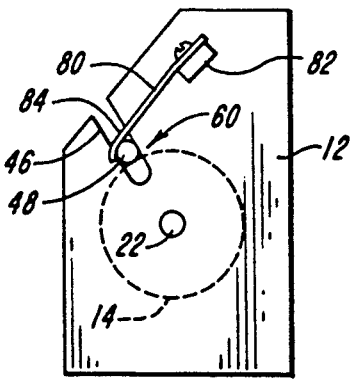
FIG. 4

COMBINATION PINCH ROLLER AND CARRIAGE GUIDE FOR PRINTER

FIELD OF THE INVENTION

This invention relates generally to printers, and more particularly to a simplified mechanism which can be used in conjunction with ink jet and other printers in which a single element serves the dual function of carriage guide and pinch roller.

BACKGROUND OF THE INVENTION

In most prior art printers, particularly impact printers, the printhead carriage rides along a pair of parallel carriage guides as it travels back and forth through the printing zone while performing the printing function. The carriage guides usually are rigid rods which are anchored at their ends to the printer frame. These types of carriage guides typically pass through bearing surfaces disposed in cooperatively formed apertures in the printhead carriage. An example of such a device is found in U.S. Pat. No. 4,808,019. Such structures are also associated with ink jet printers, as shown in U.S. Pat. No. 4,581,618.

In other types of printing mechanisms, particularly non impact printers such as ink-jet printers, only one carriage guide passes through cooperatively formed apertures in the printhead carriage, and a separate surface of the printhead carriage rests in sliding contact with a surface on another carriage guide. The weight of the printhead carriage preloads the carriage against the other carriage guide. This insures constant contact and proper referencing of the printhead to the printer frame, to which these carriage guides again are securely attached. Although pivoting of the printhead carriage about the first carriage guide may be permitted, it rarely occurs during the printing operation. An example of such a structure is found in U.S. Pat. No. 4,872,026.

In both types of prior art printing mechanisms described hereinabove, a set of rollers is required to retrieve paper from a supply and feed the paper to the printing zone. Typically, this function is performed by one or more pinch rollers in conjunction with a drive roller. These pinch rollers are separate from the carriage guides described above. Thus, two separate mechanisms are required to perform the functions of guiding the printhead carriage and feeding the paper to the printing zone. The result is a relatively large and complex mechanism.

Furthermore, in these prior art printing mechanisms described hereinabove, both the carriage guides and the platen are fixed to the printer frame, so that the positions of the printhead and the side of the paper opposite of the printable side are also fixed with respect to the frame. A drawback of these printing mechanisms is that while the printhead is referenced to the platen, it is not necessarily referenced to the printable surface of the paper, or other printing medium. Therefore, it is difficult to print on papers of different thicknesses or weights, such as envelopes, because it is not possible to easily control the spacing between the printhead and the paper as the paper thickness changes. The user can only change the printhead to-platen spacing by making time consuming manual adjustments. Thus, with prior art machines, the user is faced with the option of printing only on paper of a given weight, or of suffering a reduction of the printing quality when different weight papers are used.

Moreover, in such prior art printing mechanisms, there is a large number of parts which, when assembled, determine the spacing between the printhead and the platen. Because each part has a manufacturing tolerance associated with it, this relatively large number of parts makes it difficult to control the printhead-to-platen spacing. These problems are particularly acute for ink jet printers in which it is important that the printhead be referenced accurately to the paper.

In the somewhat complex prior art printers described hereinabove, there are several opportunities for the paper to become jammed during the printing operation, and, because of the complexity of the printer, it is frequently difficult to clear such a paper jam readily.

Accordingly, it is an object of the present invention to provide a more simplified printing mechanism.

It is another object of the present invention to provide a printing mechanism in which the printhead is accurately and automatically referenced to the printable surface of the paper to permit accommodation of papers of different weights.

It is a further object of the present invention to provide a more compact and inexpensive printer.

It is another further object of the present invention to simplify tee paper feed in a printing mechanism.

SUMMARY OF THE INVENTION

The above and other objects are achieved in accordance with the present invention in which a single element provides the dual function of a guide for the printhead carriage and a pinch roller.

In a preferred embodiment of the present invention, the printhead carriage rides along one carriage guide rod which is securely attached to the machine frame. The carriage guide rod passes through an aperture containing a bearing surface in the carriage, so that the carriage can pivot about the carriage guide rod. A roller is provided which serves the dual function of a second carriage guide and pinch roller, and operates in conjunction with the drive roller to feed paper into the printing zone. A lower surface of the printhead carriage rests on this roller at a position spaced from the carriage guide rod. The lower surface of the printhead carriage rides along in contact with the roller as the printhead carriage moves laterally to perform the printing process. Typically, a designated pad is provided on the lower surface of the carriage to facilitate alignment and movement of the carriage with respect to the roller. This pad may be incorporated into the carriage or it may be provided as a separate pad of a suitable low friction material which is attached to the carriage. The roller is spring loaded against the drive roller, so that it is continually urged toward the drive roller to perform the function of a pinch roller.

The center of gravity of the printhead carriage is disposed above the roller and spaced from the carriage guide rod so that the carriage is always preloaded downwardly onto a surface of the roller. The carriage guide rod can be disposed either on the same side of the carriage as the roller, or on a side of the carriage opposite of the roller. In preferred embodiment the carriage guide rod is disposed on the same side of the carriage as the roller, facing the paper supply, and the roller is disposed below the carriage guide rod. This alignment reduces the horizontal distance from the carriage guide rod to the printhead. In this manner, vibrations resulting from the movement of the carriage and from the printing operation have a small moment arm, producing little pivotal movement of the printhead about the carriage guide rod. Thus, the true position of the printhead remains very close to the expected position, relative to the paper, regardless of unavoidable vibrations.

Since the roller is spring loaded against the drive roller, changes in the paper thickness, or the use of envelopes, is readily accommodated. Movement of the roller with respect to the drive roller resulting from different paper thicknesses causes the printhead carriage to pivot about the carriage guide rod. This movement alters the spacing between the printhead and platen in accordance with the thickness of the paper so that proper referencing of the printhead to the paper is maintained automatically without special adjustment. Thus, the printing quality is unaffected, regardless of the thickness of the paper used.

While the foregoing mechanism is most suited to ink-jet printers, it can also be used in conjunction with impact printers. In this case, spring loading of the carriage against the roller is preferred to minimize movement of the carriage during the printing process to maintain the proper printhead-to-paper referencing.

It is preferred that paper be fed to the drive roller and roller at an angle with respect to the horizontal. This creates a bow in the paper which has the effect of stiffening it and flattening it against the platen, which helps to maintain accurate spacing between the paper and the printhead as the printhead sweeps across the area where the printing occurs. However, a horizontal feed system could be used in conjunction with this invention as well.

The foregoing invention provides a simplified printer which has reduced complexity, cost and space requirements. In addition, automatic adjustment of the spacing between the printhead and the paper is permitted when papers of different weight are used, or when envelopes are printed.

BRIEF DESCRIPTION OF THE DRAWINGS

The objects, advantages and features of this invention will be more clearly appreciated from the following detailed description taken in conjunction with the accompanying drawings in which:

FIG. 2 is a perspective view of the drive roller, pinch roller, carriage guide and printhead carriage of FIG. 1;

FIG. 3 is a plan, right side view of the apparatus of FIG. 2;

FIG. 4 is a plan, right side view of another embodiment of the arrangement of FIG. 2;

DETAILED DESCRIPTION OF THE PREFERRED EMBODIMENTS

Figure 1:
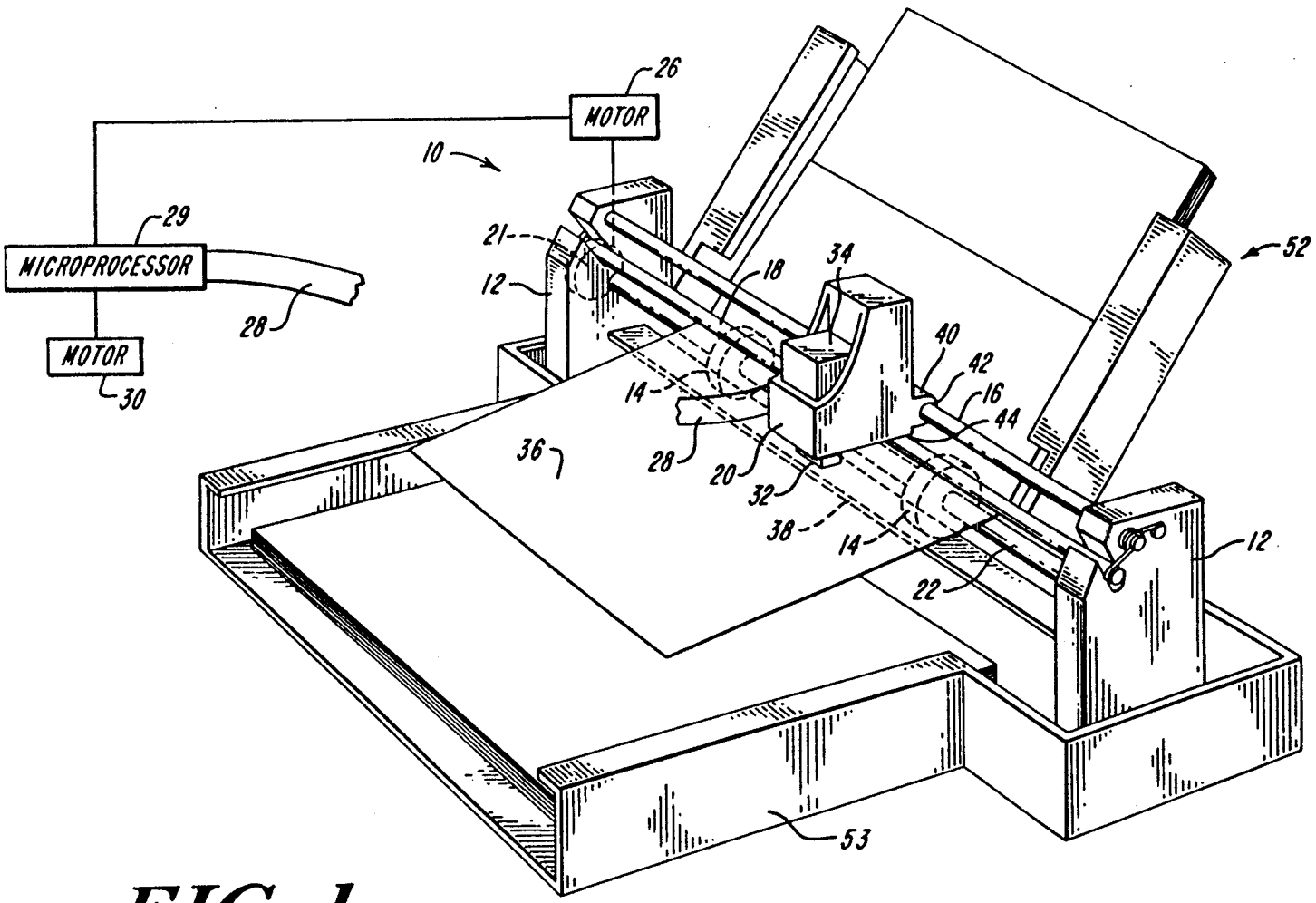
FIG. 1 is a perspective view of a printer mechanism showing one embodiment of the present invention.

With reference now to the drawings, and more particularly to FIGS. 1 and 2 thereof, one embodiment of the printer 10 of this invention will be described. Printer 10 includes a print medium supply station 52, medium collection tray 53, frame 12, drive rollers 14, carriage guide rod 16, roller 18 and printhead carriage 20.

Two or more drive rollers 14 are mounted on paper drive shaft 22, the ends of which are journaled in bearings disposed in frame 12. Drive shaft 22 and thus drive rollers 14 can be driven in any known manner by a paper drive motor 26. Paper drive motor 26 can be coupled directly to a gear 21 on drive shaft 22, as shown in FIG. 1, or it may be coupled to drive shaft 22 by any other drive apparatus (not shown) in a manner known to those skilled in the art. Paper drive motor 26, and thus movement of drive rollers 14 are controlled by a microprocessor 29 in a manner well known to those skilled in the art.

Printhead carriage 20 includes a printhead 32, and travels along carriage guide rod 16 and roller 18. Microprocessor 29 is connected by a flexible, electrical interconnect 28 to carriage 20, and in turn to the printhead 32. Microprocessor 29 also controls a carriage motor 30 which drives carriage 20. A platen 38 is disposed directly beneath printhead 32 along its path of travel. Printer 10 can operate with many types of printheads if the carriage interfaces are compatible, including piezoelectric ink jet, thermal ink jet, and impact printheads.

In a preferred embodiment, as exemplified in FIGS. 1-2, printhead 32 is disposed on a replaceable print cartridge 34, and is an ink jet printhead, such as a thermal ink jet printhead. The ink jet printer shown illustratively in FIGS. 1 2 is of the type which prints on print medium 36 in a substantially horizontal plane, although this invention is not limited to ink-jet printers or horizontal printers.

Printhead carriage 20 includes a pair of aligned projections 40 extending outwardly therefrom. Each projection 40 includes an opening 42 aligned with the opening 42 in the other projection 40, and carriage rod 16 passes through both openings 42 for guiding of printhead carriage 20. Tightly fitted bearing surfaces are provided in each opening 42 in each projection 40 to facilitate precise, smooth and nearly frictionless movement of printhead carriage 20 along carriage guide rod 16. Also, the bearings permit carriage 20 to pivot about carriage guide rod 16 when a sufficient torque is applied to carriage 20. Disposed on a bottom, rear surface of printhead carriage 20 is a designated pad 44 which either is formed as a part of the carriage 20 or is provided as a separate pad of a suitable low friction material which is attached to carriage 20. Pad 44 rests in continual contact with roller 18 providing a non-fixed relationship between carriage 20 and roller 18. Pad 44 typically extends along a portion of the width of printhead carriage 20, and provides the only area of contact between printhead carriage 20 and roller 18.

Roller 18 will now be described with particular reference to FIGS. 2 and 3. Roller 18 provides two functions: it serves as a pinch roller to facilitate feeding paper or another print medium 36 to the printing zone, and it serves as a guide for movement of printhead carriage 20. Roller 18 is rotatably mounted at its ends 48 in slots 46 in frame 12. A pair of springs 50, one disposed at each end 48, biases roller 18 against drive rollers 14 so that roller 18 is in direct contact with drive rollers 14 when no medium 36 is disposed therebetween, and roller 18 captures print medium 36 between roller 18 and drive rollers 14 in a pinch area 60 during the printing operation.

In a preferred embodiment, each spring 50 is a torsion spring, as shown in FIGS. 2 and 3. Torsion spring 50 includes a coiled portion 70 which is inserted over a mounting pin 72 secured to frame 12. One end of spring 50 rests in contact with a stop pin 74, while the other end has a curved portion 76 which rests in contact with end 48 of roller 18, to bias roller 18 downwardly into slots 46 and against drive rollers 14. In an alternative embodiment, as shown in FIG. 4, a leaf spring 80 maybe used to perform the same function as spring 50. Like numbers are used for like parts, where possible. Leaf spring 80 is mounted at one end to a mount 82 which is secured to frame 12, while the other end 84 rests in direct contact with ends 48 of roller 18. In another alternative embodiment (not shown), a leaf spring or a torsion spring may be used in conjunction with shaft 22, mounted in a slot, to bias drive rollers 14 against roller 18, mounted in fixed journals in frame 12.

Figure 5:
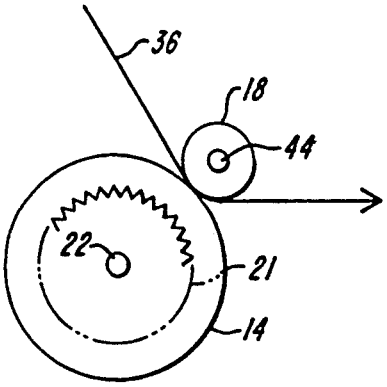
FIG. 5 is a partial, plan, side view showing a preferred arrangement of the drive roller and pinch roller of this invention.

Roller 18 may be driven by any one of a number of conventional mechanisms. In a preferred embodiment, as shown in FIGS. 1-2 and 5, roller 18 is rotated by drive rollers 14. When no paper is present, the friction between roller 18 and drive rollers 14 is sufficiently great that rotation of drive rollers 14 by shaft 22 produces similar but opposite rotation of roller 18 about its axis. When print medium 36 is disposed between roller 18 and drive rollers 14, the friction between the medium 36 and roller 18 generally is sufficient to produce the rotation of roller 18. Even if the friction between medium 36 and roller 18 is not sufficient to produce rotation of roller 18, medium 36 will still feed accurately as long as the frictional drag created is not sufficient to cause medium 36 to slip relative to drive rollers 14, since drive rollers 14 regulate feeding of the print medium.

Figure 6:
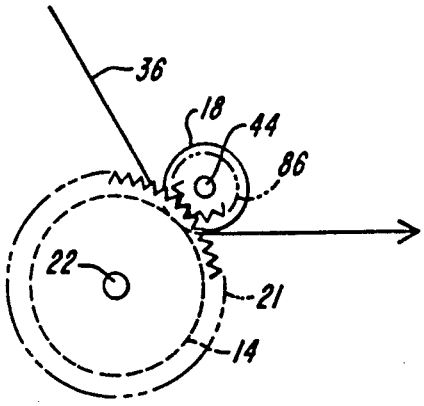
FIG. 6 is a partial, plan, side view showing another embodiment of the arrangement of the drive roller and pinch roller of this invention.
Figure 7:
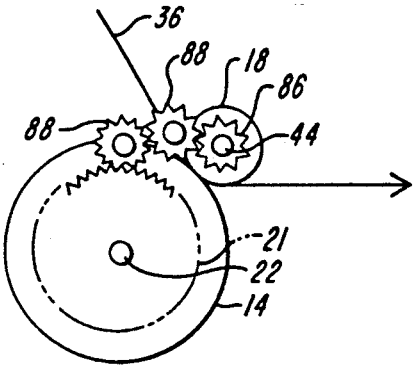
FIG. 7 is a partial, plan, side view showing another embodiment of the arrangement of the drive roller and pinch roller of this invention.

In an alternative embodiment, gears coupling shaft 22 to roller 18 can be used to produce rotation of roller 18. In one example, as shown in FIG. 6, gear 21 disposed on one end of shaft 22 meshes directly with a gear 86 disposed on an end 48 of roller 18. Typically, shaft 22 has a gear 21 disposed on only one end thereof, although gears may be disposed on both ends of shaft 22 and roller 18. Alternatively, gears 86 and 21 are joined by an even number of idler gears 88, as shown in FIG. 7, which shows two gears 88 as a typical example. An even number of idler gears 88 is required to produce the desired opposite rotation of rollers 14 and roller 18. Regardless of the driving mechanism utilized, gears 21 and 86 should be selected so that roller 18 has about the same surface speed as drive rollers 14. Whether the shafts are not coupled with gears, or whether gears 21 and 86 are directly coupled, or whether idler gears 88 are used or whether another method of coupling is used depends upon the particular implementation of the printer.

The position of roller 18 on the circumference of drive rollers 14 depends upon the angle $\theta$ (FIG. 8) with which print medium 36 is fed to drive rollers 14, and may be readily determined by one of ordinary skill in the art depending on the particular implementation of this invention. An angle of $\theta=60°$ is preferred for the embodiment shown. Drive rollers 14 typically comprise a synthetic rubber material suitable for driving paper and for generating the desired frictional coupling between drive rollers 14 and the print medium 36.

Carriage guide rod 16 is spaced from roller 18 and drive rollers 14 and is positioned so that rod 16 is spaced from the center of gravity of printhead carriage 20. Also, preferably roller 18 is positioned so that the weight of carriage 20 preloads carriage 20 onto roller 18 so that pad 44 and roller 18 are urged into continual contact. In a preferred embodiment, the center of gravity of carriage 20 is disposed at or above roller 18. For an ink-jet printer, the weight of the printhead carriage generally is sufficient to maintain this continual contact. However, if an impact printer is used, a spring system or other biasing means (not shown) may be required to maintain contact between pad 44 and roller 18 during the printing operation. Continual contact between roller 18 and pad 44 ensures that printhead 32 is always properly referenced to print medium 36 in the printing zone. Proper referencing is important to provide a high quality printed product, particularly with ink jet printers.

Figure 8:
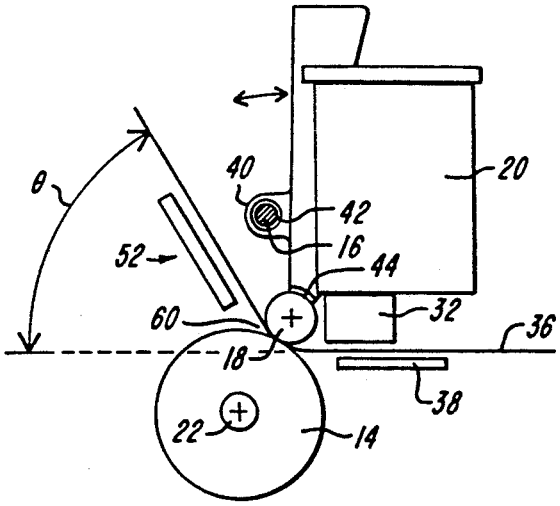
FIG. 8 is a partial, plan, side view of a preferred embodiment of this invention.

Preferably, although not necessarily, roller 18 is disposed below rod 16. In a preferred embodiment, as shown in FIGS. 1-2 and 8, rod 16 is disposed on the same side of carriage 20 as roller 18. Typically, rod 16 also is disposed on the same side of carriage 20 as supply station 52, although the orientation of rod 16 with respect to supply station 52 is not important and depends primarily upon other design features of the printer, such as the desired relative locations for the paper supply station 52 and collection tray 53.

Printhead carriage 20 is permitted to pivot about carriage guide rod 16 at openings 42, if sufficient torque is applied to carriage 20. Thus, as roller 18 is lifted off drive rollers 14, carriage 20 also is raised at pad 44, pivoting carriage 20 about rod 16 and, conversely, as roller 18 moves toward drive rollers 14, carriage 20 is lowered at pad 44. As paper is supplied to drive rollers 14 and roller 18 from paper supply station 52 in pinch area 60, roller 18 is urged away from drive rollers 14, and the spacing between roller 18 and rollers 14 increases, the amount of the spacing being a function of paper thickness. Changes in the spacing between roller 18 and rollers 14 cause corresponding, but smaller changes in the spacing between printhead 32 and platen 38. However, little or no change in the spacing between printhead 32 and print medium 36 is produced by a change in the spacing between rollers 18 and rollers 14, so that the spacing between printhead 32 and print medium 36 is maintained within the desired tolerances for papers of different thicknesses.

Any known type of supply station 52 or collection tray 53 may be used in conjunction with this invention. The feeding mechanism may be either a continuous paper feed, a manual feed or an automatic single sheet feed apparatus, all of which are known to those skilled in the art. In any event, it is preferred that a sheet or a continuous medium 36 be fed around roller 18, through pinch area 60 and onto platen 38 in a non linear fashion, so that a bow is provided in print medium 36 as it passes from feed station 52 to platen 38N. The angle $\theta$ of this bow preferably is between about 15° and 60°. (See FIG. 8). This bow or change in direction is caused by the positioning of supply station 52, drive rollers 14, roller 18 and platen 38. The bow in medium 36 assists in straightening the medium and flattening it against the platen 38, so that the spacing between the printhead 32 and the medium 36 is accurate and consistent as the printhead 32 sweeps across the area where printing occurs. Providing the bow, and referencing the print medium 36 and printhead 32 to the same part, namely, roller 18, results in substantially consistent print quality from one sheet of print medium to the next, regardless of media thickness or part tolerances.

Figure 9:
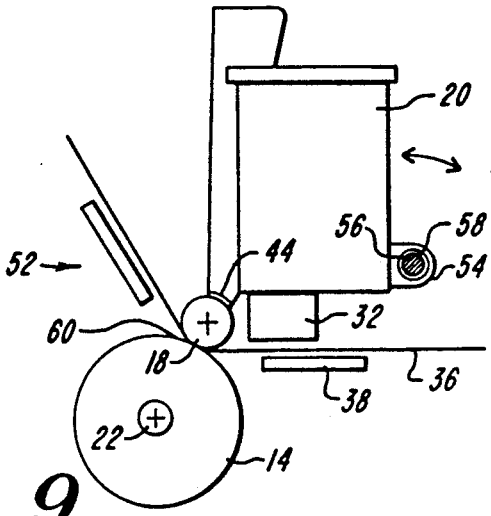
FIG. 9 is a partial, plan, side view of an alternative embodiment of this invention.

An alternative embodiment of this invention is shown in FIG. 9. Like numbers are used for like parts where possible. In this embodiment, projections 40 and carriage guide rod 16 of the embodiment of FIGS. 1-2 and 8 are replaced by projections 54 and carriage guide rod 56 respectively. While projections 40 and carriage guide rod 16 were disposed on the same side of printhead carriage 20 as roller 18, projections 54 and carriage guide rod 56 are disposed on a side of printhead carriage 20 opposite of roller 18, and typically, although not necessarily, facing away from paper supply station 52. Carriage guide rod 56 passes through associated bearing surfaces within an opening 58 in each projection 54 and is anchored to frame 12. In this embodiment, the center of gravity of printhead carriage 20 is disposed between roller 18 and carriage guide rod 56. The center of gravity of printhead carriage 20 is, as in the previous embodiment, preferably positioned above roller 18, and is spaced from rod 56. In this manner, the weight of printhead carriage 20 again preloads pad 44 of carriage 20 against roller 18. In all other respects, the embodiment of FIG. 9 is identical to that of FIGS. 1, 2 and 8.

The embodiment of FIGS. 1, 2 and 8 is preferred for certain types of printers, especially ink jet printers. In an ink-jet printer, many of the vibrations observed in printhead carriage 20 are caused by friction between roller 18 and pad 44. In the configuration shown in FIGS. 1-2 and 8, where roller 18 is disposed below rod 16, the horizontal distance from rod 16 to printhead 32 is small. In this manner, vibrations resulting from the movement of printhead carriage 20 and from the printing operation have a small moment arm, producing little pivotal movement of printhead 32 about rod 16. Thus, the true position of the printhead 32 remains very close to the expected position, relative to medium 36, regardless of unavoidable vibrations. Thus, the high printing quality is ensured.

Conversely, in the embodiment of FIG. 9, the moment arm between the pivot point, rod 56, and roller 18 is greater than in the embodiment of FIGS. 1, 2 and 8, so that vibrations or frictional effects may cause greater horizontal motion of printhead 32 with respect to medium 36. While such vibrational effects are not expected to be a serious problem in either embodiment, better results are likely to be achieved for ink jet printers with the embodiment of FIGS. 1-2 and 8 than with the embodiment of FIG. 9. The embodiment of FIG. 9 may be preferred for other types of printers.

In the case of an impact printer, the impact of the printhead on the printing medium applies an upward reactionary force to printhead carriage 20 directly over platen 38, applying a torque to printhead carriage 20 about rod 16 or rod 56, depending on whether the embodiment of FIGS. 1-2 and 8 or that of FIG. 9 is used. As previously indicated, in such an impact printer, means (not shown) for biasing printhead carriage 20 downwardly against roller 18 are employed to counteract these reactionary forces resulting from the printing process.

The operation of the embodiment of the FIGS. 1, 2 and 8 will now be described. A print medium, such as paper, is fed from supply station 52 into the printer either as single, discrete sheets, or as a continuous sheet. This medium is fed into the pinch area 60 between roller 18 and drive roller 14 where it is grasped by rollers 14 and 18. The preferred angle of feed with respect to the horizontal, when platen 38 is in a roughly horizontal orientation, is about 60°. However, the feed angle may be any angle less than 60°, including zero degrees. Feed angles greater than 60° are also permissible.

As the paper passes through pinch area 60, a bow is provided to the paper. As the paper approaches platen 38, it is inclined slightly downwardly, and platen 38 urges the paper into a horizontal orientation. Printhead carriage 20 is driven by motor 30 to the desired position where the printing operation is performed. Printhead carriage 20 rides along carriage rod 16 with pad 44 in contact with roller 18. Because the center of gravity of carriage 20 is disposed above roller 18, and is spaced from carriage rod 16, and because rod 16 is spaced from roller 18, the weight of printhead carriage 20 is sufficient to preload pad 44 against roller 18. As print medium 36 enters pinch area 60, the thickness of medium 36 urges roller 18 upwardly away from drive rollers 14 against the bias of springs 50. Upward movement of roller 18 urges printhead carriage 20 upwardly, pivoting carriage 20 about rod 16. This upward pivoting of carriage 20 increases the spacing between printhead 32 and platen 38, so that the spacing between printhead 32 and the surface of print medium 36 as it passes over platen 38 remains relatively constant for different thicknesses of print medium. In this manner, the desired referencing of print medium 36 to printhead 32 is maintained, regardless of the thickness of medium 36, during the printing operation.

The foregoing invention permits a printer, particularly an ink-jet printer, to achieve a more compact and simplified construction. In addition, this invention permits automatic maintenance of the proper referencing between the printing surface of print medium 36 and printhead 32, regardless of the thickness of print medium 36, obviating the need to make manual adjustments for different types of print media. Further, this invention allows for more accurate spacing between the printhead 32 and the printable surface of the medium 36, by reducing the number of parts involved in producing that spacing. Because the printer is smaller and less complex, it is easier to repair, and paper jams are less likely to occur and can be more easily corrected.

In view of the above description, it is likely that modifications and improvements will occur to those skilled in the art which are within the scope of this invention. The above description is intended to be exemplary only, the scope of the invention being defined by the following claims and their equivalents.

What is claimed is:

1. Apparatus for printing on a printing medium comprising:

a frame;

a printhead carriage having a printhead for printing on a printing medium in a printing area;

drive roller means journaled in said frame;

means for guiding movement of said printhead carriage in the printing area;

an elongated roller, having a direction of elongation, said elongated roller being rotatably disposed in said frame and being rotatable along an axis generally parallel to the direction of elongation, said elongated roller being disposed generally parallel to said drive roller means, said printhead carriage resting on and riding along said elongated roller in a non-fixed relationship, said elongated roller cooperating with said drive roller means to provide the printing medium to the printing area for printing thereon, said elongated roller also cooperating with said guiding means to guide movement of said printhead carriage in the printing area; and means for moving said printhead carriage along said guiding means and said elongated roller for positioning said printhead in a desired location in the printing area.

2. Apparatus as recited in claim 1 wherein said printer is an ink-jet printer.

3. Apparatus as recited in claim 1 wherein said guiding means is disposed on the same side of said printhead carriage and said roller elongated.

4. Apparatus as recited in claim 1 wherein said guiding means is disposed on a side of said printhead carriage opposite of said elongated roller.

5. Apparatus as recited in claim 1 wherein said elongated roller and said drive roller means form a pinch zone therebetween for grabbing the printing medium and supplying the printing medium to the printing area.

6. Apparatus as recited in claim 1 wherein said guiding means is spaced from said elongated roller.

7. Apparatus as recited in claim 1 wherein said elongated roller is journaled in and supported by said frame.

8. Apparatus as recited in claim 1 wherein said elongated roller is adapted to contact the printing medium.

9. Apparatus as recited in claim 1, further comprising means for rotatably driving said elongated roller in coordination with said drive roller means.

10. Apparatus as recited in claim 1, further comprising a platen for supporting the printing medium in the printing area.

11. Apparatus as recited in claim 1 wherein a center of gravity of said printhead carriage is spaced from said guiding means.

12. Apparatus as recited in claim 11 wherein a center of gravity of said printhead carriage is disposed above said elongated roller.

13. Apparatus as recited in claim 1 further comprising means for biasing together said elongated roller and said drive roller means.

14. Apparatus as recited in claim 13 wherein said elongated roller is urged outwardly away from said drive roller means by the print medium passing between said drive roller means and said elongated roller.

15. Apparatus as recited in claim 14 wherein a spacing between a printing surface on the printing medium and said printhead remains generally constant for different spacings of said elongated roller from said drive roller means.

16. Apparatus as recited in claim 1 further comprising:

means for pivotally mounting said printhead carriage to said guiding means at a position spaced from a center of gravity of said printhead carriage; and a surface disposed on a lower portion of said printhead carriage resting on said elongated roller and traveling along in contact with said second elongated roller during movement of said printhead carriage, said surface being spaced from and below said guiding means.

17. Apparatus as recited in claim 16 further comprising means for supplying the printing medium to said drive roller means and wherein said guiding means is disposed on a side of said printhead carriage facing said supplying means.

18. Apparatus as recited in claim 16 further comprising means for supplying the printing medium to said drive roller means and wherein said guiding means is disposed on a side of said printhead carriage facing away from said supplying means.

19. Apparatus as recited in claim 16 wherein said guiding means is disposed on the same side of said printhead carriage as said elongated roller.

20. Apparatus as recited in claim 16 wherein said guiding means is disposed on a side of said printhead carriage opposite of said elongated roller.

21. Apparatus as recited in claim 1 wherein said elongated roller comprises a cylindrical roller.

22. Apparatus as recited in claim 21 wherein said cylindrical roller is journaled in said frame.

23. Apparatus as recited in claim 22, further comprising a platen, disposed substantially parallel to said cylindrical roller and connected to said frame, for supporting the printing medium in the printing area.

24. An ink-jet printer comprising:

a frame;

a printhead carriage having an ink-jet printhead disposed thereon;

a platen disposed in confronting closely spaced relation with said ink-jet printhead and having a direction of elongation;

drive roller means journaled in said frame and having a direction of elongation generally parallel to the direction of elongation of said platen;

a pinch roller disposed generally parallel to said drive roller means, having a direction of elongation generally parallel to the direction of elongation of said platen and to the direction of elongation of said drive roller means, and being rotatable along an axis parallel to the direction of elongation of said pinch roller;

means for urging into contact said pinch roller and said drive roller means to form a pinch zone therebetween, said drive roller means and said pinch roller cooperating to supply the printing medium to a printing area between said platen and said ink-jet printhead;

means for providing the printing medium to said pinch zone;

means for moving said printhead carriage in a direction generally parallel to the direction of elongation of said drive roller means for positioning said printhead in a desired location;

means for guiding movement of said printhead carriage in a direction generally parallel to the direction of elongation of said drive roller means, said guiding means being spaced from said pinch roller; and means for pivotally connecting said printhead carriage to said guiding means at a position spaced from a center of gravity of said printhead carriage, said printhead carriage having a surface resting in contact with said pinch roller during movement of said printhead carriage, said surface being disposed below a center of gravity of said printhead carriage, said carriage and said pinch roller having a non-fixed relationship.

25. Apparatus as recited in claim 24 wherein said guiding means is disposed on a side of said printhead carriage opposite to said pinch roller.

26. Apparatus as recited in claim 24 wherein said guiding means is disposed on the same side of said printhead carriage as said pinch roller.

27. Apparatus as recited in claim 24 wherein the printing medium urges apart said pinch roller and said drive roller means at said pinch zone whereby a spacing between said ink jet printhead and a printing surface on said printing medium remains generally constant regardless of the thickness of the printing medium.

28. Apparatus as recited in claim 24, further comprising means for rotatably driving said pinch roller in coordination with said drive roller means.

29. Apparatus for printing on a printing medium comprising:

a frame;

a printhead carriage having a printhead for printing on a printing medium in a printing area;

drive roller means journaled in said frame;

means for guiding movement of said printhead carriage in the printing area;

second roller means disposed generally parallel to said drive roller means, said printhead carriage resting on and riding along said second roller means, said second roller means cooperating with said drive roller means to provide the printing medium to the printing area for printing thereon, said second roller means also cooperating with said guiding means to guide movement of said printhead carriage in the printing area;

means for moving said printhead carriage along said guiding means and said second roller means for positioning said printhead in a desired location in the printing area;

first driving means, connected to said drive roller means, for rotatably driving said drive roller means; and second driving means, connected to said second roller means and having a positive mechanical connection to said first driving means, for rotatably driving said second roller means in coordination with said drive roller means.

30. Apparatus as recited in claim 29 wherein:

said first driving means comprises a first gear; and said second driving means comprises a second gear.

* * * * *